US006910922B2

(12) United States Patent
Haga

(10) Patent No.: US 6,910,922 B2
(45) Date of Patent: Jun. 28, 2005

(54) CONNECTOR IN WHICH OCCURRENCE OF CROSSTALK IS SUPPRESSED BY A GROUND CONTACT

(75) Inventor: Goro Haga, Akishima (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/785,512

(22) Filed: Feb. 24, 2004

(65) Prior Publication Data

US 2004/0166700 A1 Aug. 26, 2004

(30) Foreign Application Priority Data

Feb. 25, 2003 (JP) ..... 2003-047799

(51) Int. Cl.[7] ..... H01R 13/648
(52) U.S. Cl. ..... 439/608; 439/101
(58) Field of Search ..... 439/608, 108, 439/101, 79

(56) References Cited

U.S. PATENT DOCUMENTS 5,842,887 A 12/1998 Andrews
6,174,202 B1 * 1/2001 Mitra ..... 439/608
6,322,379 B1 11/2001 Ortega et al.
6,364,710 B1 * 4/2002 Billman et al. ..... 439/608
6,371,813 B2 * 4/2002 Ramey et al. ..... 439/608
6,443,740 B1 * 9/2002 Evans ..... 439/63
6,471,549 B1 10/2002 Lappöhn
6,478,624 B2 * 11/2002 Ramey et al. ..... 439/608
6,506,076 B2 * 1/2003 Cohen et al. ..... 439/608
6,527,587 B1 * 3/2003 Ortega et al. ..... 439/608
6,666,696 B1 * 12/2003 Wu ..... 439/108

FOREIGN PATENT DOCUMENTS

| | | |
|---|---|---|
| EP | 0 393 251 | 10/1990 |
| EP | 0 975 054 | 1/2000 |
| EP | 1 113 530 | 7/2001 |
| EP | 1 241 735 | 9/2002 |
| JP | 2000067955 | 10/2000 |
| JP | 2001028284 | 1/2001 |

* cited by examiner

*Primary Examiner*—Gary Paumen
(74) *Attorney, Agent, or Firm*—Collard & Roe, P.C.

(57) ABSTRACT

In a connector (1) to be connected to a circuit board (5), a signal contact (3) is disposed between first and second ground contacts (4) and held by an insulator (2) together with the first and the second ground contacts. Each of the signal contact, the first ground contact, and the second ground contact has a terminal portion to be connected to the circuit board. The first ground contact has an extended portion extending from the terminal portion thereof towards the second ground contact. The first and the second ground contacts are cooperated with each other to substantially surround the terminal portion of the signal contact with using the extended portion.

11 Claims, 4 Drawing Sheets

CONNECTOR IN WHICH OCCURRENCE OF CROSSTALK IS SUPPRESSED BY A GROUND CONTACT

This application claims priority to prior Japanese application JP 2003-47799, the disclosure of which is incorporated herein by reference.

BACKGROUND OF THE INVENTION

The present invention relates to a connector to be connected to a circuit board.

For example, Japanese Patent Application Publication (JP-A) No. 2001-28284 discloses a coaxial connector for use in a circuit board. The coaxial connector disclosed in the publication comprises a plurality of signal leads disposed on an electronic circuit package and a plurality of ground members each of which surrounds each of the signal leads on three sides thereof. Each of the ground member is connected to a ground terminal disposed between adjacent ones of the signal leads.

Further, Japanese Patent Application Publication (JP-A) No. 2000-67955 discloses a balanced transmission line connector comprising a plurality of signal contact pairs each of which is surrounded by a plurality of ground members so as to prevent occurrence of crosstalk.

In each of the connectors mentioned above, it is required to contain the ground member of a special design. As a result, the connector is increased in size and complicated in structure.

SUMMARY OF THE INVENTION

It is therefore an object of the present invention to provide a simple and compact connector capable of suppressing occurrence of crosstalk without requiring a ground member of a special design.

Other objects of the present invention will become clear as the description proceeds.

According to an aspect of the presents invention, there is provided with a connector to be connected to a circuit board. The connector comprises an insulator, first and second ground contacts held by the insulator and spaced from each other, and a signal contact disposed between the first and the second ground contacts and held by the insulator. Each of the signal contact, the first ground contact, and the second ground contact has a terminal portion to be connected to the circuit board. The first ground contact has an extended portion extending from the terminal portion thereof towards the second ground contact. The first and the second ground contacts are cooperated with each another to substantially surround the terminal portion of the signal contact with using the extended portion.

According to another aspect of the presents invention, there is provided with a connector to be connected to a circuit board. The connector comprises an insulator to be engaged with the circuit board, a plurality of signal contacts held by the insulator and arranged in a single row in a first direction, and a plurality of ground contacts held by the insulator and arranged in a single row in the first direction. Each of the signal contacts has a terminal portion formed at one end in a second direction perpendicular to the first direction to be connected to the circuit board, and a contacting portion formed at the other end in the second direction to be connected to a mating member to be connected to the connector. Each of the ground contacts has a terminal portion formed at one end in the second direction to be connected to the circuit board, a contacting portion formed at the other end in the second direction to be contacted with the mating member, and a pair of flat plate portions protruding from the terminal portions of each of the ground contacts in the first direction and spaced from each other in a third direction perpendicular to the first and the second directions. The signal contacts and the ground contacts are alternately disposed. The terminal portion of each of the signal contacts is surrounded on three sides by the terminal portions of adjacent ones of the ground contacts and the flat plate portions.

DESCRIPTION OF THE PREFERRED EMBODIMENT

Figure 1A:
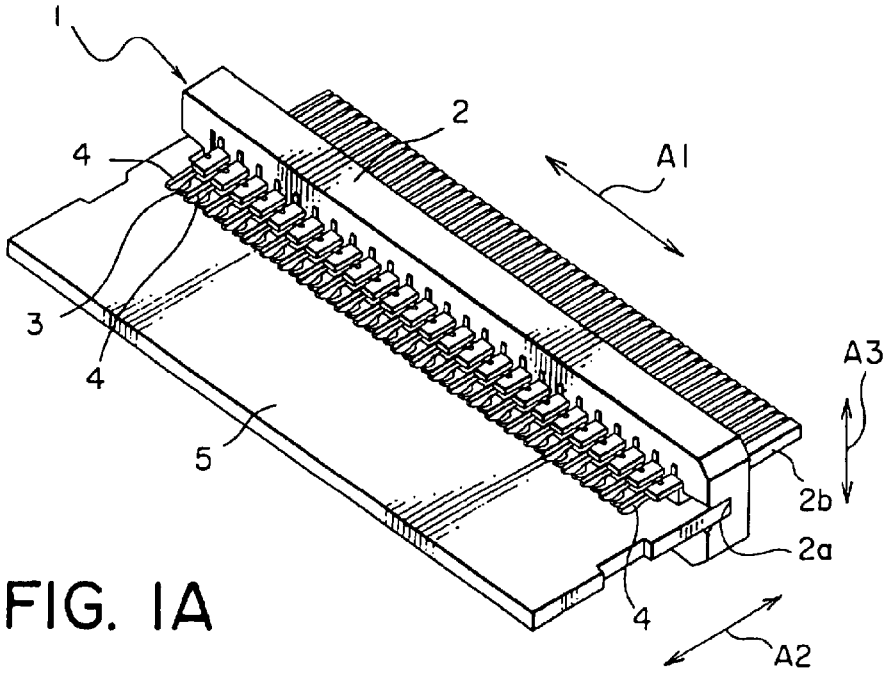
FIG. 1A is a perspective view showing a whole structure of a connector according to an embodiment of the present invention.
Figure 1B:
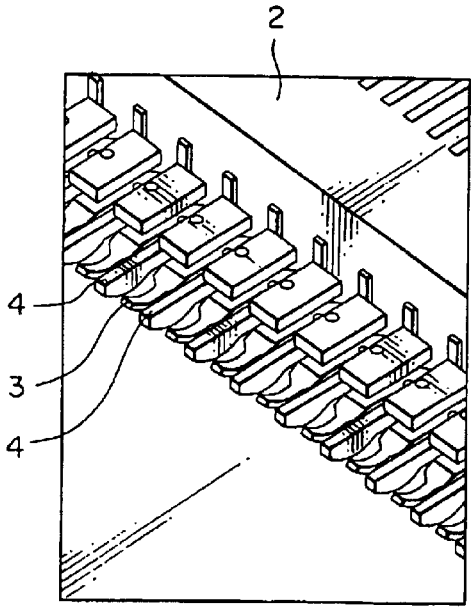
FIG. 1B is an enlarged view of a part of the connector illustrated in FIG. 1A as seen from a particular angle.
Figure 1C:
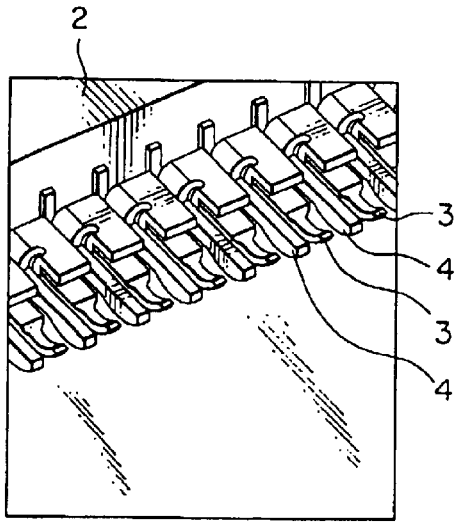
FIG. 1C is a view similar to FIG. 1B as seen from a different angle.

Referring to FIGS. 1A to 1C, description will be made of a whole structure of a connector according to an embodiment of the present invention.

The connector is depicted by a reference numeral 1 and comprises an insulator 2 having a rectangular shape elongated in a first direction A1, a number of signal contacts 3 made of metal and held by the insulator 2, and a number of ground contacts 4 made of metal. The signal contacts 3 are arranged in a single row in the first direction A1 and spaced from one another at a predetermined pitch. The ground contacts 4 are also arranged in a single row in the first direction A1 and spaced from one another at a predetermined pitch.

The signal contacts 3 and the ground contacts 4 are alternately arranged. At opposite ends in the first direction A1, the ground contacts 4 are disposed. Therefore, between every adjacent ones of the ground contacts 4, the signal contact 3 is arranged. Herein, one of the adjacent ground contacts 4 is referred to as a first ground contact, another of the adjacent ground contacts 4 being referred to as a second ground contact.

The insulator 2 is provided with a groove 2*a* formed on one side surface thereof in a second direction A2 perpendicular to the first direction A1. The groove 2*a* is adapted to receive a circuit board 5, such as a printed board, to be press-fitted therein. Further, the insulator 2 is provided with a protrusion 2*b* formed on the other side surface in the second direction A2.

Figure 2:
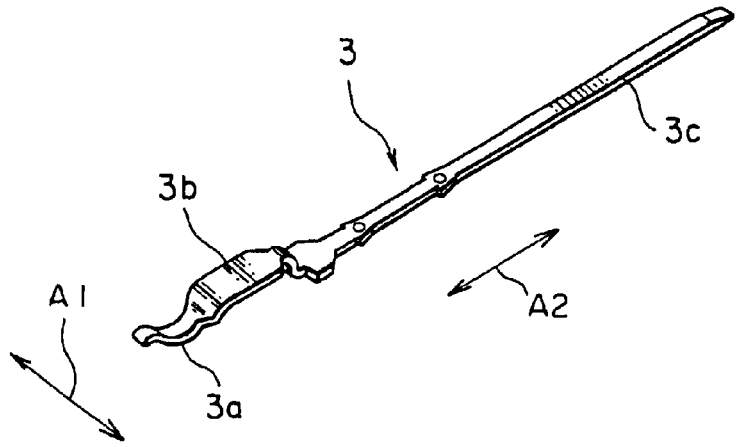
FIG. 2 is an enlarged perspective view of a signal contact used in the connector illustrated in FIG. 1A.

Referring to FIG. 2 in addition, the signal contacts 3 will be described.

Each of the signal contacts 3 has, at its one end in the second direction A2, a lead portion 3*a* for soldering and an enlarged portion 3*b* in the vicinity of the lead portion 3*a*. The enlarged portion 3*b* is widened in the first direction A1. By changing the width or the thickness of the enlarged portion 3*b*, the impedance is adjusted. A combination of the lead portion 3*a* and the enlarged portion 3*b* is referred to as a terminal portion to be connected to the circuit board 5.

Each of the signal contacts 3 has, at the other end in the second direction A2, a contacting portion 3*c* to be connected to a signal contact of a mating connector to be mated with the connector 1.

Figure 3:
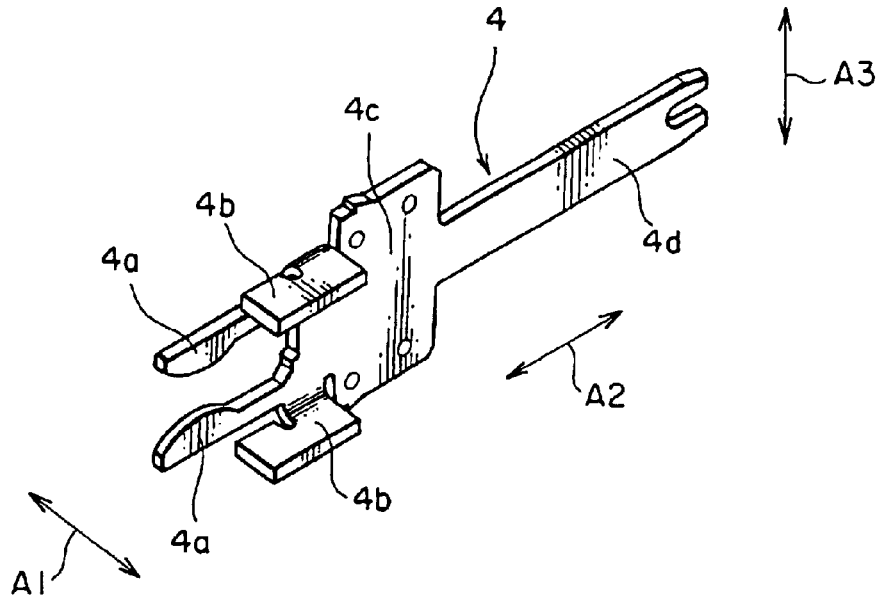
FIG. 3 is an enlarged perspective view of a ground contact used in the connector illustrated in FIG. 1A.
Figure 4:
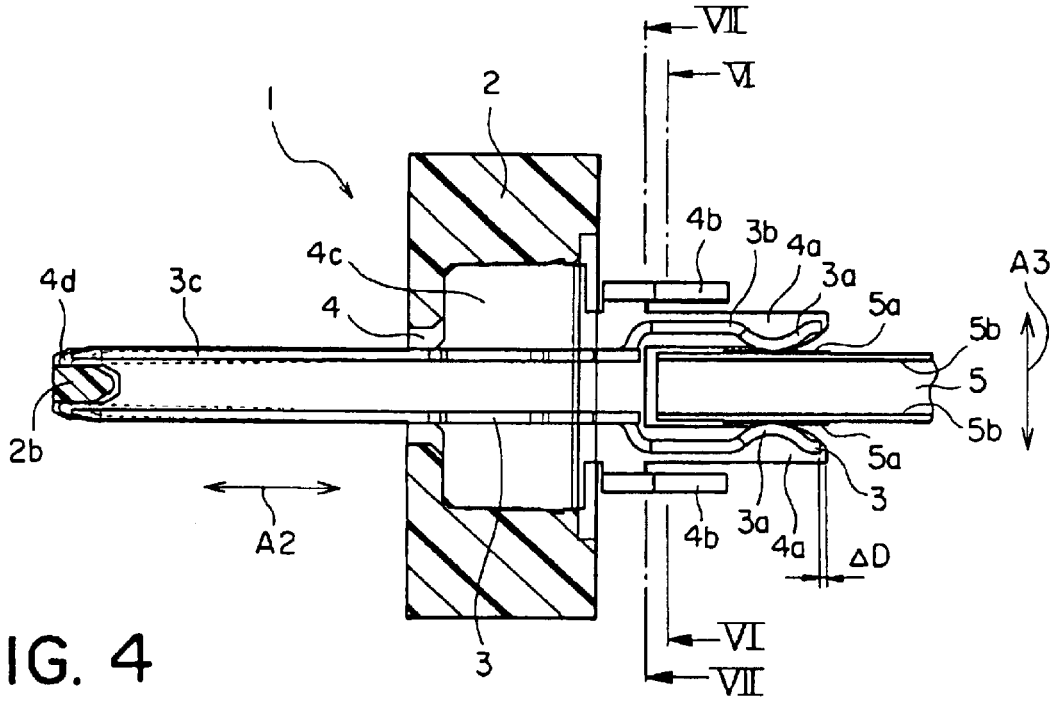
FIG. 4 is a sectional view of the connector illustrated in FIG. 1A.
Figure 5:
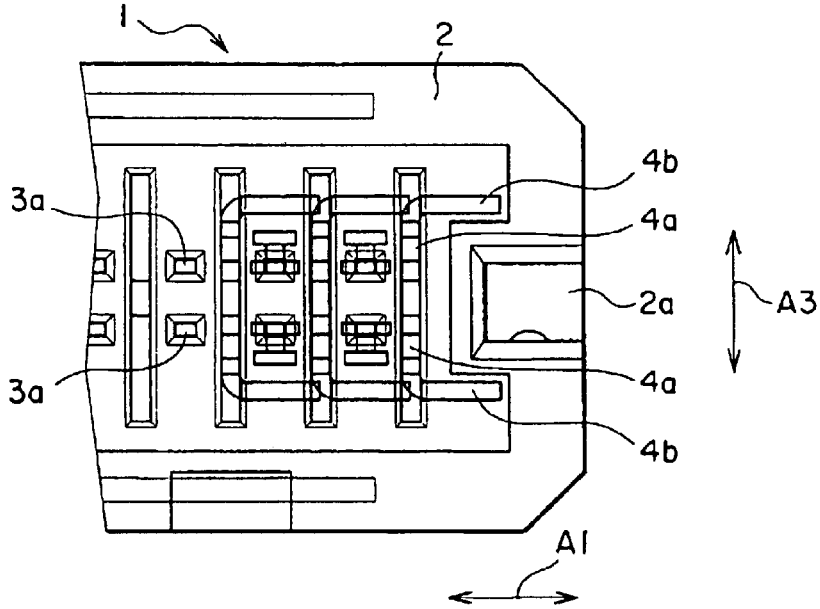
FIG. 5 is a front view of a part of the connector illustrated in FIG. 1A.
Figure 6:
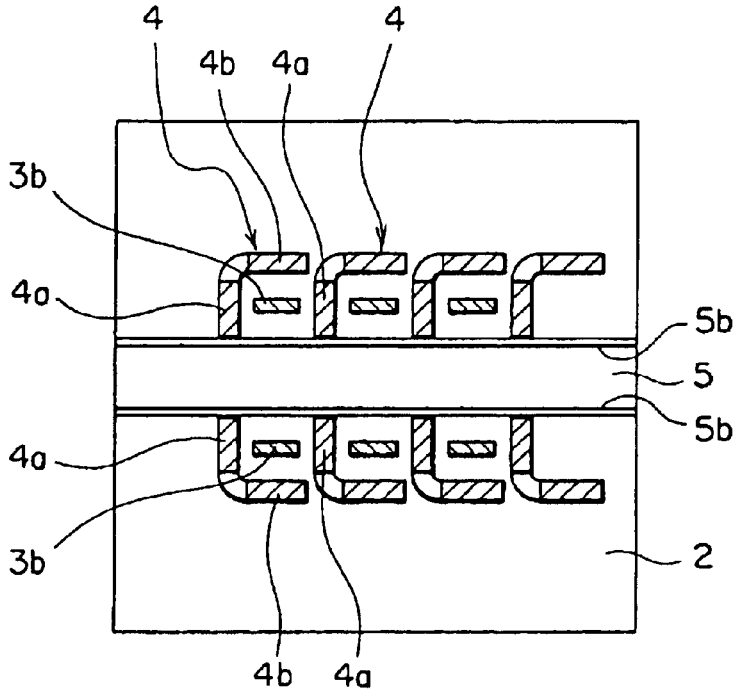
FIG. 6 is a sectional view of a part of the connector, taken along a line VI—VI in FIG. 4.
Figure 7:
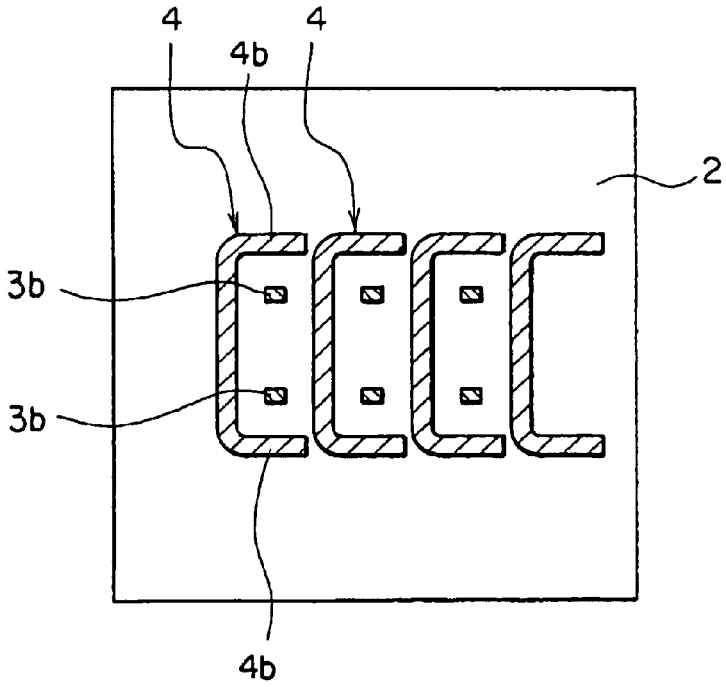
FIG. 7 is a sectional view a part of the connector, taken along a line VII—VII in FIG. 4.

Referring to FIG. 3 in addition, the ground contacts 4 will be described.

Each of the ground contacts 4 is made of a plate material and has, at one end in the second direction A2, a pair of lead portions 4*a* for soldering, a pair of flat plate portions 4*b* in the vicinity of the lead portions 4*a*, and a wide holding portion 4*c* adjacent to the flat plate portions 4*b*. The lead portions 4*a* extend on a plane spreading in the second direction A2 and a third direction A3 perpendicular to the first and the second directions A1 and A2 and spaced from each other. A combination of the lead portions 4*a* will be referred to as a terminal portion to be connected to the circuit board 5.

The flat plate portions 4*b* are perpendicularly bent from opposite edges of the terminal portion to extend in the same direction or on the same side in the first direction A1. Therefore, the flat plate portions 4*b* are faced to each other and spaced from each other in the third direction A3. A combination of the flat plate portions 4*b* will be referred to as an extending portion. The holding portion 4*c* is adapted to be held by the insulator 2.

Each of the ground contacts 4 has, at the other end in the second direction A2, a contacting portion 4*d* to be connected to a ground contact of a mating connector to be mated with the connector 1. As will become clear later, each of the ground contacts 4 has a symmetrical shape in the third direction A3 because it is used in common on both of first and second principal surfaces of the circuit board 5. For convenience of description, the first and the second principal surfaces will be referred to as upper and lower surfaces, respectively.

Referring to FIGS. 4 to 7 in addition, the connector 1 will be described in detail.

The circuit board 5 is provided with a number of signal patterns 5*a* formed on opposite surfaces thereof in the third direction A3, i.e., the upper and the lower surfaces. The signal patterns 5*a* on the opposite surfaces of the circuit board 5 are located opposite to each other in the third direction A3.

The signal contacts 3 include upper signal contacts faced to the signal patterns 5*a* on the upper surface of the circuit board 5 and lower signal contacts faced to the signal patterns 5*a* on the lower surface of the circuit board 5. Thus, the upper and the lower signal contacts 3 faced to each other in the third direction A3 forms a pair. The upper and the lower signal contacts 3 in each pair are at least partially disposed between the flat plate portions 4*b* of each of the ground contacts 4. As a result, by every adjacent ones of the ground contacts 4 cooperating with each other and by using the flat plate portions 4*b*, the terminal portions of the upper and the lower signal contacts 3 in each pair are substantially completely surrounded. Either one of the upper and the lower signal contacts 3 in each pair may be referred to as an additional signal contact.

Through a space between the upper and the lower signal contacts 3 in each pair, the circuit board 5 is inserted into the groove 2*a* illustrated in FIG. 1. The circuit board 5 is provided with a pair of ground plane layers 5*b* adjacent to the upper and the lower surfaces thereof, respectively. When the circuit board 5 is inserted into the groove 2*a*, the lead portions 3*a* of the upper and the lower signal contacts 3 in each pair are faced to and brought into press contact with the signal patterns 5*a* on the upper and the lower surfaces of the circuit board 5, respectively. The lead portions 4*a* of each of the ground contacts 4 are faced to and brought into contact with the ground plane layers 5*b* on the upper and the lower surfaces of the circuit board 5, respectively. The signal contact 3 is shorter in length by ΔD than the ground contact 4.

With the above-mentioned structure, opposite sides of the enlarged portion 3*b* of the signal contact 3 in the third direction A3 are faced to the flat plate portion 4*b* of the ground contact 4 and the ground plane layer 5*b*, respectively. Further, opposite sides of the signal contact 3 in the first direction A1 are faced to adjacent ones of the ground contacts 4, respectively. Therefore, each of the signal contacts 3 is shielded in four directions (on four sides), i.e., in leftward, rightward, upward, and downward directions (on left, right, up, and down sides). It is therefore possible to suppress the occurrence of crosstalk.

The flat plate portions 4*b* of the ground contact 4 surround the enlarged portions 3*b* of the signal contacts 3. Preferably, greater portions of the signal contacts 3 are surrounded by the flat plate portions 4*b*.

Thus, each of the signal contacts 3 is shielded by the ground contacts 4 and the ground plane layer 5*b* of the circuit board 5 in the four directions (on the four sides), i.e., the left, the right, the upward, and the downward directions (on left, right, up, and down sides). Alternatively, the signal contact 3 may be shielded in the three directions (on the three sides) without the ground plane layer 5*b*.

In the foregoing description, the connector 1 is mounted to the upper and the lower surfaces of the circuit board 5 but may be mounted to only one of the upper and the lower surfaces.

Although this invention has thus far been described in conjunction with the preferred embodiment thereof, it will readily be possible for those skilled in the art to put this invention into practice in various other manners without departing the scope of the appended claims.

What is claimed is:

1. A connector to be connected to a circuit board, said connector comprising:

an insulator;

a first and a second ground contact held by said insulator and spaced from each other; and a signal contact disposed between said first and said second ground contact and held by said insulator, said signal contact, said first ground contact, and said second ground contact each having a terminal portion to be connected to said circuit board;

said first ground contact having an extended portion extending from the terminal portion thereof towards said second ground contact; and said first and said second ground contact cooperating with each other to substantially surround the terminal portion of said signal contact by means of said extended portion.

2. The connector according to claim 1, wherein said extended portion has a pair of flat plate portions facing each other, the terminal portion of said signal contact being at least partially disposed between said flat plate portions.

3. The connector according to claim 2, wherein said flat plate portions extend from the terminal portion of said first ground contact.

4. The connector according to claim 1, wherein each of said terminal portions has a lead portion facing said circuit board.

5. The connector according to claim 1, wherein said circuit board has a first surface and a second surface opposite to the first surface, the terminal portions of said first and said second ground contacts having a pair of lead portions facing said first and said second surfaces of said circuit board, respectively.

6. The connector according to claim 5, wherein the terminal portion of said signal contact has a lead portion facing only said first surface of said circuit board.

7. The connector according to claim 6, further comprising an additional signal contact disposed between said first and said second ground contacts and held by said insulator, the terminal portion of said signal contact and a terminal portion of said additional signal contact being substantially completely surrounded by said first and said second ground contacts.

8. The connector according to claim 7, wherein said terminal portion of said additional signal contact has a lead portion facing only the second surface of said circuit board.

9. The connector according to claim 1, wherein said first and said second ground contacts are arranged in parallel in a first direction, each of said first and said second ground contacts being provided with said terminal portion at one end in a second direction perpendicular to said first direction and with a contacting portion formed at the other end in said second direction to be contacted with a mating member to be connected to said connector.

10. The connector according to claim 1, wherein each of said first and said second ground contacts are made of a plate material.

11. A connector to be connected to a circuit board, said connector comprising:

an insulator to be engaged with said circuit board;

a plurality of signal contacts held by said insulator and arranged in a single row in a first direction; and a plurality of ground contacts held by said insulator and arranged in a single row in the first direction, each of said signal contacts having:

a terminal portion formed at one end in a second direction perpendicular to said first direction to be connected to said circuit board; and a contacting portion formed at the other end in the second direction to be connected to a mating member to be connected to said connector, each of said ground contacts having:

a terminal portion formed at one end in the second direction to be connected to said circuit board;

a contacting portion formed at the other end in the second direction to be contacted with said mating member; and a pair of flat plate portions protruding from said terminal portions of each of said ground contacts in said first direction and spaced from each other in a third direction perpendicular to said first and said second directions, said signal contacts and said ground contacts being alternately disposed, said terminal portion of each of said signal contacts being surrounded on three sides by the terminal portions of adjacent ones of said ground contacts and said flat plate portions.

* * * * *